US005455482A

United States Patent [19]

Han

[11] Patent Number: 5,455,482

[45] Date of Patent: Oct. 3, 1995

[54] CATHODE RAY TUBE

[75] Inventor: Yu-cheol Han, Kwacheon, Rep. of Korea

[73] Assignee: Samsung Electron Devices Co., Ltd., Kyungki, Rep. of Korea

[21] Appl. No.: 34,432

[22] Filed: Mar. 19, 1993

[30] Foreign Application Priority Data

Aug. 3, 1992 [KR] Rep. of Korea ..... 92-13951

[51] Int. Cl.[6] ..... H01J 29/70

[52] U.S. Cl. ..... 313/440; 313/439

[58] Field of Search ..... 313/439–440, 313/414, 425

[56] References Cited

U.S. PATENT DOCUMENTS

| | | | |
|---|---|---|---|
| 4,427,917 | 1/1984 | Mizushima et al. | 313/439 |
| 5,059,858 | 10/1991 | Shimoma et al. | 313/440 |
| 5,121,028 | 6/1992 | Milili | 313/440 |
| 5,177,399 | 1/1993 | Fujiwara et al. | 313/440 |

*Primary Examiner*—Stephen Brinich
*Attorney, Agent, or Firm*—Lowe, Price, LeBlanc & Becker

[57] ABSTRACT

Disclosure is related to a cathode ray tube including a panel formed with a fluorescent layer, and a funnel connected to the panel and provided with an electron gun and a deflection yoke installed inside and near the neck portion, respectively, which satisfies the following equation:

$$(L1/L2)\times(D/S)=\alpha$$

where L1 denotes the distance from the outlet of the last accelerating electrode to the end of the deflection yoke, L2 denotes the distance between the outlet of the last accelerating electrode and the reference line which is the boundary between the deflection region and the linear region of the electron beams, D denotes the inner diameter of the neck portion and S denotes the eccentric distance between the centers of electron beam passing holes of electrodes. α is between 0.5 and 1.5. The cathode ray tube can prevent the electron beam from colliding with the cone portion near the neck and mislanding in the corner areas of the fluorescent layer.

1 Claim, 2 Drawing Sheets

CATHODE RAY TUBE

CROSS REFERENCE TO RELATED APPLICATIONS

This application is related to co-pending application Ser. No. 08/034,433, filed Mar. 19, 1993.

BACKGROUND OF THE INVENTION

The present invention relates to a cathode ray tube, and more particularly to a cathode ray tube which prevents the mislanding of the electron beam emitted from an electron gun and intended for the corner areas of a fluorescent layer, after colliding with the inner surface of the funnel.

Generally, a cathode ray tube as shown in FIG. 1, comprises a panel 10 on whose inner surface is formed a fluorescent layer 11, and a funnel 20 connected to panel 10 and including an electron gun 22 mounted inside a neck portion 21 and a deflection yoke 23 installed around the cone portion near the neck portion. In the cathode ray tube of FIG. 1, an electron beam emitted from electron gun 22 is deflected by deflection yoke 23 according to the scanning position on fluorescent layer 11, to land on fluorescent layer 11 and thus form a pixel; many such pixels are gathered to form a picture. However, since the screen is elongated in the horizontal direction, the deflection angle is enlarged, so that the electron beam emitted from electron gun 22 collides with the inner surface of funnel 20 and cannot be precisely landed in the corner areas of fluorescent layer 11. The collision against the inner surface of funnel 20 by the electron beam emitted from electron gun 22 and intended for the corner areas of fluorescent layer 11, is due to the shape of funnel 20, installation conditions of deflection yoke 23, positioning of electron gun 22 and deflection yoke 23, etc. If, to solve the above problems, the cone portion near the neck of funnel 20 is formed such that it is large enough for the electron beam to avoid the above-described collision, the cathode ray tube must be enlarged accordingly, which necessitates that each part thereof be designed differently. Particularly, a cathode ray tube so enlarged significantly increases the process time required to adequately vacuumize its interior.

SUMMARY OF THE INVENTION

The object of the present invention is to provide a cathode ray tube which prevents the electron beam emitted from an electron gun from colliding with the cone portion of a funnel to subsequently misland, when intended for the corner areas of a fluorescent layer.

To achieve the above object of the present invention, there is provided a cathode ray tube comprising a panel formed with a fluorescent layer on the inner surface thereof, and a funnel connected to the panel and provided with an electron gun and a deflection yoke installed inside and near the neck portion thereof, respectively, which satisfies the following equation:

$$(L1/L2)\times(D/S)=\alpha$$

where, L1 represents the distance from the outlet of a last accelerating electrode to the end of the deflection yoke, L2 denotes the distance between the outlet of the last accelerating electrode and the reference line which is the boundary between the deflection region where the electron beam is deflected and curved by the deflection yoke and the linear region where the electron beam moves linearly, D denotes the inner diameter of the neck portion, and S denotes the eccentric distance between the centers of electron beam passing holes of an electrode constituting the electron gun. Here, the desired resultant value of $\alpha$ is between 0.5 and 1.5.

BRIEF DESCRIPTION OF THE DRAWINGS

Further features and advantages will become more apparent from the following and more particular description of the preferred embodiment of the invention as illustrated in the accompanying drawings in which the same reference characters generally refer to like parts throughout the views, and in which.

DETAILED DESCRIPTION OF THE INVENTION

Figure 1:
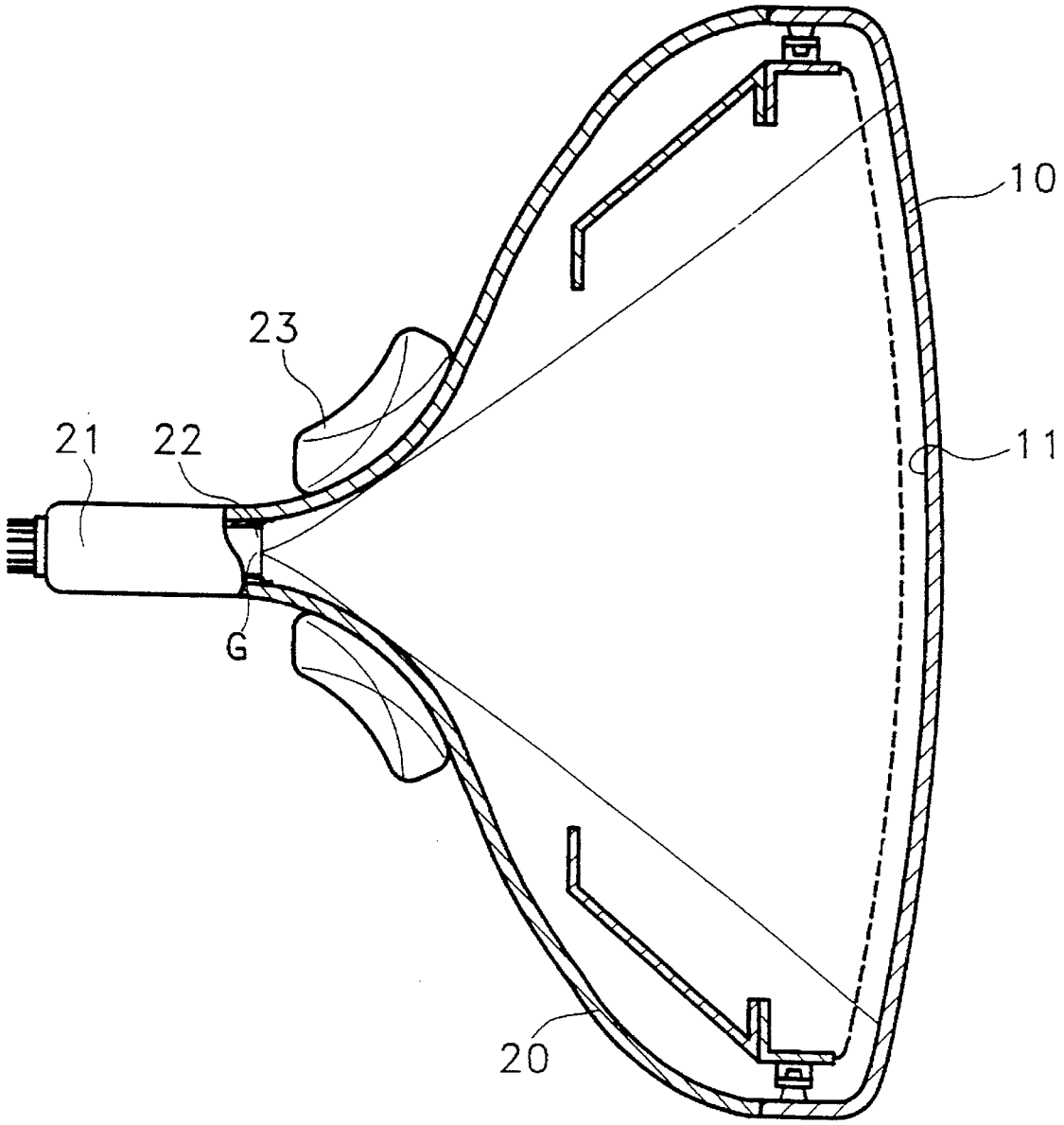
FIG. 1 (PRIOR ART)
FIG. 1 is a cut-away side view of a conventional cathode ray tube.
Figure 2:
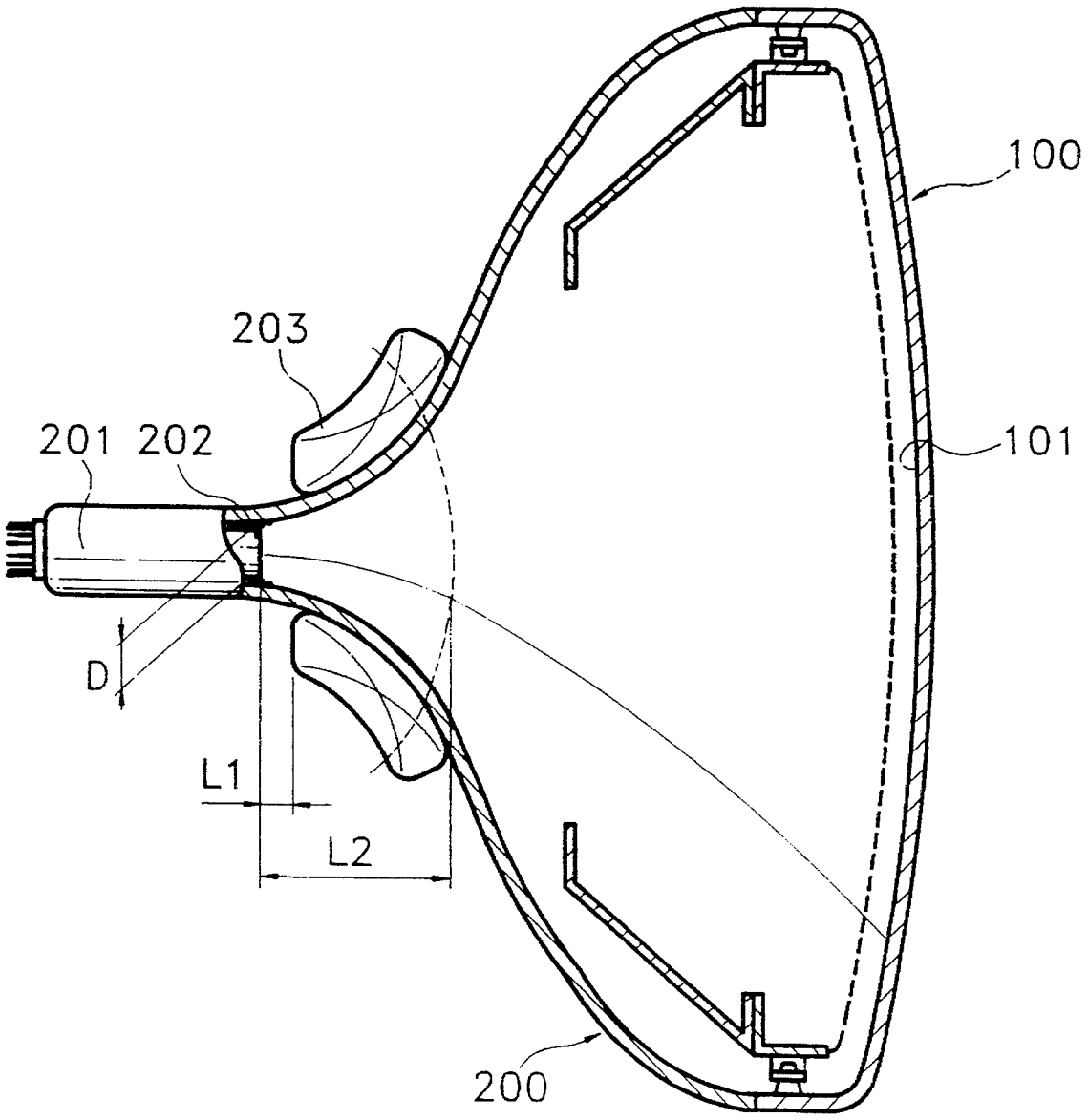
FIG. 2 is a cut-away side view of a cathode ray tube according to the present invention.

Generally, a cathode ray tube comprises a panel 100 formed with a fluorescent layer 101 on the inner surface thereof, and a funnel 200 connected to panel 100 and provided with an electron gun 202 mounted inside a neck portion 201 and a deflection yoke 203 installed around the cone portion near the neck portion which electively deflects the electron beam emitted from electron gun 202 according to the scanning position of fluorescent layer 101. In the cathode ray tube constructed as above, the deflection angle of the electron beam emitted from electron gun 202 becomes large according as the screen becomes elongated in the horizontal direction. At this time, the electron beam emitted from electron gun 202 collides with the inner surface of funnel 200 and cannot precisely land in the corner areas of fluorescent layer 101, so that the picture of the corner areas are not clear. The inventor has studied the causes of the above problems (i.e., why the electron beam emitted from the electron gun cannot precisely land in the corner areas of the fluorescent layer), and found the following contributing factors to such a phenomenon: (1) the installation condition of a deflection yoke and the magnitude of the deflection angle; (2) the eccentric distance between the centers of electron beam passing holes of three electron guns emitting red, blue and green beams, respectively; (3) the distance between the outlet of the last accelerating electrode and the reference line which is the boundary between the deflection region where the electron beam emitted from the electron gun is deflected and curved by the deflection yoke and the linear region where the electron beam moves linearly; and (4) the inner diameter of a neck portion in which the electron gun is mounted.

Accordingly, in order to prevent the electron beam emitted from the electron gun from colliding with the inner surface of the cone portion near the neck and mislanding in the corner areas of the fluorescent layer, the inventor made the following equation in respect to the above reasons, and experimented to draw out the result as shown in Tables 1 and 2:

$$(L1/L2)\times(D/S)=\alpha$$

where L1 denotes the distance from the outlet of a last accelerating electrode to the end of the deflection yoke, L2 denotes the distance between the outlet of the last accelerating electrode and the reference line, D denotes the inner diameter of the neck portion in which the electron gun is mounted, and S denotes the eccentric distance between the centers of electron beam passing holes of electrodes constituting the electron gun.

TABLE 1

| Eccentric distance | Neck Diameter | L1 | L2 | α | generation of BSC* |
|---|---|---|---|---|---|
| 5.6 | 37.5 | 5 | 70 | $\frac{5}{70} \times \frac{37.5}{5.6} = 0.478$ | Δ |
| | | 13 | 70 | $\frac{13}{70} \times \frac{37.5}{5.6} = 1.244$ | O |
| | | 20 | 70 | $\frac{20}{70} \times \frac{37.5}{5.6} = 1.913$ | X |
| 7.0 | 37.5 | 5 | 70 | $\frac{5}{70} \times \frac{37.5}{7.0} = 0.383$ | X |
| | | 13 | 70 | $\frac{13}{70} \times \frac{37.5}{7.0} = 0.995$ | O |
| | | 20 | 70 | $\frac{20}{70} \times \frac{37.5}{7.0} = 1.531$ | O |

*beam struck cone

TABLE 2

| Eccentric distance | Neck Diameter | L1 | L2 | α | generation of BSC* |
|---|---|---|---|---|---|
| 7 | 37.5 | 20 | 60 | $\frac{20}{60} \times \frac{37.5}{7} = 1.786$ | X |
| | | 20 | 70 | $\frac{20}{70} \times \frac{37.5}{7} = 1.531$ | Δ |
| | | 20 | 80 | $\frac{20}{80} \times \frac{37.5}{7} = 1.339$ | O |
| 7 | 32.5 | 20 | 60 | $\frac{20}{60} \times \frac{32.5}{7} = 1.548$ | Δ |
| | | 20 | 70 | $\frac{20}{70} \times \frac{32.5}{7} = 1.327$ | O |
| | | 20 | 80 | $\frac{20}{80} \times \frac{32.5}{7} = 1.161$ | O |

*beam struck cone
O: BSC is not generated
Δ: about 20% BSC generation
X: BSC is generated As shown in Tables 1 and 2, when α is less than 0.5, the electron beam emitted from electron gun 202 collides with the cone portion and mislands with respect to the corner areas of fluorescent layer 101, while when the distance between the outlet of the last accelerating electrode of electron gun 202 and reference line is long, the electron beam does not collide with the inner neck portion 201 but the volume of neck portion 201 is enlarged. Accordingly, as shown in the above Tables, when α is more than 0.5 or less than 1.5, the best design can be performed without the volume of the funnel being enlarged, so that the cathode ray tube has a uniform resolution throughout the whole screen.

In the cathode ray tube of the present invention, the deflection angle of the electron beam emitted from the electron gun becomes large according as the screen becomes elongated in the horizontal direction. At this time, the electron beam emitted from the electron gun does not collide with the cone portion near the neck of the funnel and can be precisely landed in the corner areas of the fluorescent layer. Also, the funnel can be optimally designed without increasing its volume.

Having described a preferred embodiment of the present invention, it will be clear to those skilled in the art that modifications and alternatives to the disclosed apparatus exist within the scope and spirit of the present invention. Accordingly, it is intended to limit the scope of the present invention only as indicated in the following claims.

What is claimed is:

1. A cathode ray tube comprising a panel formed with a fluorescent layer on the inner surface thereof, and a funnel connected to said panel and provided with an electron gun and a deflection yoke installed inside and near the neck portion thereof, respectively, which satisfies the following equation:

$$(L1/L2)\times(D/S)=\alpha$$

where L1 denotes the distance from the outlet of the last accelerating electrode to the end of said deflection yoke, L2 denotes the distance between the outlet of said last accelerating electrode and the reference line which is the boundary between the deflection region where the electron beam is deflected or curved by said deflection yoke and the linear region where the electron beam moves linearly, D denotes the inner diameter of said neck portion, and S denotes the eccentric distance between the centers of electron beam passing holes of an electrode constituting said electron gun (for α values between 0.5 and 1.5).

* * * * *